US011306473B2

(12) United States Patent
Heatly

(10) Patent No.: US 11,306,473 B2
(45) Date of Patent: Apr. 19, 2022

(54) PRECAST MODULAR STRUCTURAL BUILDING METHOD

(71) Applicant: Scott Edward Heatly, Albuquerque, NM (US)

(72) Inventor: Scott Edward Heatly, Albuquerque, NM (US)

( * ) Notice: Subject to any disclaimer, the term of this patent is extended or adjusted under 35 U.S.C. 154(b) by 0 days.

(21) Appl. No.: 16/683,495

(22) Filed: Nov. 14, 2019

(65) Prior Publication Data

US 2020/0131754 A1 Apr. 30, 2020

Related U.S. Application Data

(62) Division of application No. 15/901,042, filed on Feb. 21, 2018, now Pat. No. 10,550,565.

(51) Int. Cl.

| | |
|---|---|
| ***E04B 1/04*** | (2006.01) |
| ***E04B 5/48*** | (2006.01) |
| ***E04B 5/43*** | (2006.01) |
| ***E04H 9/02*** | (2006.01) |
| ***E04F 15/024*** | (2006.01) |
| ***E04H 9/14*** | (2006.01) |
| ***E04C 2/06*** | (2006.01) |
| ***E04B 5/23*** | (2006.01) |

(Continued)

(52) U.S. Cl.

CPC ..... *E04B 1/043* (2013.01); *E02D 27/02* (2013.01); *E04B 1/04* (2013.01); *E04B 1/046* (2013.01); *E04B 1/14* (2013.01); *E04B 1/41* (2013.01); *E04B 5/23* (2013.01); *E04B 5/43* (2013.01); *E04B 5/48* (2013.01); *E04C 2/044* (2013.01); *E04C 2/06* (2013.01); *E04C 2/38* (2013.01); *E04C 3/294* (2013.01); *E04F 15/02405* (2013.01); *E04H 9/029* (2013.01); *E04H 9/14* (2013.01); *E04B 2001/246* (2013.01); *E04B 2001/2415* (2013.01); *E04B 2001/2463* (2013.01); *E04B 2001/2466* (2013.01); *E04B 2001/2484* (2013.01); *E04B 2001/4192* (2013.01); *E04H 9/0235* (2020.05)

(58) Field of Classification Search

CPC ..... E04B 5/43; E04B 5/23; E04B 5/00; E04B 1/04; E04B 1/14; E04B 1/41; E04B 1/046; E04B 2001/4192; E04B 1/6137; E04B 1/6158; E04C 3/294; E04C 2/06; E04C 2/38; E04C 2/044; E04H 9/14

See application file for complete search history.

(56) References Cited

U.S. PATENT DOCUMENTS 973,165 A * 10/1910 Cahill ..... E04B 5/23 52/340

1,564,264 A * 12/1925 Murray ..... E04B 5/23 52/319

(Continued)

*Primary Examiner* — Jessie T Fonseca

(74) *Attorney, Agent, or Firm* — Gina T. Constant, Esq.

(57) ABSTRACT

The present invention is a modular structural building method consisting of prefabricated, precast, composite reinforced concrete raised floor and steel beam panels with adjustable levelling connection assemblies between panels, supported by columns. The system has the ability to accommodate the use of the floor by construction personnel during the on-site assembly process. The perimeter of the raised floor slab can be provided with ducts for a field installed conventional reinforcement means to create a continuous structural diaphragm for the floor panel.

1 Claim, 9 Drawing Sheets

(51) Int. Cl.

| | |
|---|---|
| ***E04C 3/294*** | (2006.01) |
| ***E04B 1/41*** | (2006.01) |
| ***E04B 1/14*** | (2006.01) |
| ***E04C 2/04*** | (2006.01) |
| ***E04C 2/38*** | (2006.01) |
| ***E02D 27/02*** | (2006.01) |
| *E04B 1/24* | (2006.01) |

(56) References Cited

U.S. PATENT DOCUMENTS 1,660,370 A * 2/1928 Billner ..... E04B 5/23 52/440
2,047,109 A * 7/1936 Nagel ..... E04C 2/044 52/405.3
2,215,975 A * 9/1940 Rackle ..... E04B 5/04 52/440
2,306,320 A * 12/1942 Rapp ..... E04B 5/46 52/306
2,466,106 A * 4/1949 Hoge ..... E04B 5/10 52/483.1
3,368,016 A * 2/1968 Birguer ..... E04C 3/293 264/228
3,434,263 A * 3/1969 Wald ..... F16B 3/005 52/715
3,478,481 A * 11/1969 Schuppisser ..... E04B 1/043 52/432
3,491,499 A * 1/1970 Dyer ..... E04B 5/08 52/396.04
3,555,753 A * 1/1971 Magadini ..... E04B 5/023 52/223.7
3,596,423 A * 8/1971 Jacobus ..... B28B 1/084 52/332
3,645,056 A * 2/1972 Gerola ..... E04B 1/043 52/259
3,762,115 A 10/1973 McCaul, III
3,775,928 A * 12/1973 Dawson ..... E04B 1/04 52/745.13
4,006,570 A * 2/1977 Stolz ..... E04B 1/32 52/432
4,398,378 A * 8/1983 Heitzman ..... E04B 5/04 52/251
5,311,629 A * 5/1994 Smith ..... E01D 22/00 14/73.1
5,761,862 A 6/1998 Hendershot
6,668,412 B1 * 12/2003 Tadros ..... E01D 19/125 14/73
6,668,507 B2 12/2003 Blanchet
8,011,147 B2 9/2011 Hanlan
8,468,766 B1 * 6/2013 Keenan ..... E04B 5/023 403/270
8,499,511 B2 8/2013 Platt
2001/0008319 A1 * 7/2001 Kistner ..... E04C 2/044 264/135
2002/0069602 A1 * 6/2002 Blanchet ..... E04H 9/14 52/600
2002/0083991 A1 * 7/2002 Sorkin ..... E04C 5/10 138/121
2003/0061672 A1 * 4/2003 Eustace ..... E01D 2/00 14/77.1
2004/0107660 A1 * 6/2004 Moreau ..... E04B 5/10 52/336
2006/0075707 A1 * 4/2006 Cretti ..... E04B 5/026 52/414
2008/0016805 A1 * 1/2008 Walter ..... E02D 35/00 52/263
2008/0092466 A1 * 4/2008 Zirbel ..... E04B 5/04 52/223.6
2008/0134598 A1 * 6/2008 Rizzuto ..... E04C 5/08 52/223.13
2009/0188194 A1 * 7/2009 Williams ..... E04B 5/40 52/414
2011/0113714 A1 * 5/2011 Hsu ..... E04B 5/40 52/434
2015/0275499 A1 * 10/2015 Lubberts ..... E04C 2/46 52/281

* cited by examiner

PRECAST MODULAR STRUCTURAL BUILDING METHOD

CROSS-REFERENCE TO RELATED APPLICATIONS

This application is a divisional of U.S. Pat. No. 10,550,565 entitled "Precast Modular Structural Building System and Method," which claimed the benefit of the filing of Provisional Application No. 62/462,759, filed on Feb. 23, 2017, entitled "Precast Modular Structural Building System." The specification and claims of both prior-filed applications are incorporated here by reference.

BACKGROUND OF THE INVENTION

The field of the present invention is generally the design and construction industry and specifically precast concrete and structural steel construction systems.

The advantages of reinforced concrete have long been known in the building industry and reinforced concrete raised floors have been commonly used in buildings. But pouring the concrete on site, also known as casting in place, to create a structure is slow, labor intensive, and costly.

Construction projects using the cast-in-place technique for raised floors require extensive use of formwork, steel floor beam installation, galvanized metal deck installation, slab reinforcing installation, and the installation of slab embedded mechanical, electrical, IT, and plumbing items (MEP). All of this must be completed prior to casting the floor slab. This makes them heavier and costlier than the modular structural building system of the present invention. Additionally, the pouring, curing, and drying of concrete is weather dependent as time, moisture, and temperature play a part in the process and the quality.

In addition to the quality and time issues associated with the cast-in-place process, there are additional project schedule issues because, even once poured, it can be weeks before the concrete raised floor is in a condition to be walked on by the construction trades. Therefore, the construction of cast-in-place concrete raised floor slabs is always on the leading edge, or critical path, of the project schedule. Any time that can be gained through an early release of these raised floor slabs to trades will result in quicker project schedules, safer jobsites, and more cost-effective projects.

Rather than the cast-in-place process, precast concrete panels set in place and joined together on-site to create a raised floor have gained acceptance as a method to reduce time, labor, and material costs. Precast systems also provide a solution for remote jobsites that lack access to raw concrete. But current precast concrete floor panel systems have a variety of limitations and disadvantages. These floors are typically made of solid concrete and are thus much heavier than cast-in-place floors, which incorporate lighter steel components. The heaviness results in larger and more costly foundations and lateral systems. Further, precast raised floor slabs are usually simply installed side by side, often requiring the additional, cast-in-place pouring of a topping slab, which adds time and money to a project. A topping slab is also often required in precast raised floor systems in order to resist the seismic loads induced in moderate to severe earthquake exposure areas. But topping slabs can have their own surface defect issues depending on how they are poured. There can be additional camber, deflection, levelness, and flatness issues due in part to transitions across pre-cast floor panel connections.

Precast hollow core planks are also commonly used in the industry. These planks are extruded from dies and constructed of concrete material with continuous circular hollow openings the full length of the floor plank. These planks are reinforced with either conventional or prestressed reinforcing. Due to the extrusion process associated with hollow core planks, the final finish is rough and not aesthetically pleasing if left exposed and also may be difficult for floor finishes to adhere to properly. The top of hollow core slabs often has a dimple defect because as the concrete is extruded the top shell deflects downwards prior to the hardening of the concrete.

U.S. Pat. No. 8,499,511 to Platt, et al, discloses a precast composite floor system that combines the use of double tees and wide flange steel beams but does not have the advantages of the present invention, including levelling connection assemblies and the grout splicing method.

Also, U.S. Pat. No. 6,668,507 to Blanchet discloses a precast composite building system that combines the use of precast wall and floor panels and steel beams (primarily S-shaped), with welded joints between panels. This system does not have the benefits of the present invention such as the improved method of splicing adjacent floor panels, improved leveling connections, and it lacks the diaphragm chord reinforcement feature.

Thus, there is a need in the industry for a precast modular structural building system that addresses the limitations of the prior art. There is a further need in the industry to provide a modular building system with enhanced connection strength and levelling between composite raised floor panels. The present invention is designed to address these needs.

BRIEF SUMMARY OF THE INVENTION

The present invention addresses the problems described above with an entirely new structural system consisting of prefabricated, precast, composite concrete floor and steel beam panels with adjustable levelling connection assemblies between panels, optimally supported by steel columns, although other supports, such as wide flange steel girders, can be accommodated. The structural system also has the ability to accommodate the use of the floor by construction personnel during the on-site assembly process. The perimeter of the raised floor slab can be provided with hollow ducts for a field installed conventional reinforcement means to create a continuous structural diaphragm for the floor panel.

The composite beam system (beam connected to concrete during pre-casting process) of the present invention combines two industries, concrete and steel, that do not currently work together to address the multitude of problems in the current environment. The method of this invention, where these raised floors are installed at the building site, allows the trades to work on the raised floor immediately, leading to substantial time and money savings as well as fewer safety incidents.

As described above, cast-in-place and precast concrete raised floor systems can have camber, deflection, levelness, and flatness issues. The unique adjustable levelling connection assembly in this invention provides the capability to use torque to draw two adjacent floor panels level with each other.

Additionally, precast slabs are not cast with ducts, channels, conduits, or voids for future placement of perimeter reinforcement, such as rebar or chord steel, radiant floor heating, Wi-Fi wiring, fires suppression systems, or other MEP systems. This invention provides this capability. Further, the raised floor panels of the present invention can be provided with insulation to meet the project's thermal and sound attenuation needs and with clips, tracks or light gauge framing for the construction of mechanical chases or architectural soffits under the floor.

A topping slab is often required in precast raised floor systems for structural support and earthquake resistance. The floors and roof of a building are generally designed to act as diaphragms, which refer to horizontal or sloped systems that act to transmit lateral forces to lateral load-resisting elements. The panel system of the present invention can vary in thickness to address required diaphragm capacity, without requiring a topping slab.

Further, the perimeter of the raised floor slab can be provided with ducts or channels for a field installed conventional reinforcement means. In one embodiment, a fully developed overlapping welded wire fabric connection can be created across all joints along with continuous reinforcing in the perimeter concrete slabs creating a continuous diaphragm for the floor panel. A continuous cable can be field placed through an embedded metal duct located at the perimeter of the diaphragm to resist the tension chord forces. This cable can be prestressed strand that is post-tensioning or un-tensioned. Conventional reinforcement, such as rebar, can also be utilized.

The method of the present invention uses the modular structural building system described herein to install raised floors comprising the steps of precasting a plurality of raised floor panels, transporting the precast raised floor panels to the building site, attaching each precast raised floor panel to at least one beam such that the precast raised floor panels are suspended and stable enough for construction personnel to walk on the precast raised floor panels, connecting adjacent angled edges of the precast raised floor panels to each other, installing within the receptacle created by connecting adjacent angled edges to each other at least one adjustable levelling connection assembly, said assembly being capable of using torque to draw two adjacent raised floor panels level, applying torque to the adjustable levelling connection assembly until the adjacent precast raised floor panels are level; and filling the receptacle with grout.

As used herein, certain terms have the following definitions:

"Angle" can be any shape that, when connected to the adjacent "angled" edge of another panel, a receptacle is created that can receive grout including, but not limited to V-shaped, U-shaped, or rounded or squared or any combination of the above.

"Beam" includes a beam with an "I" shaped cross-section (I-beam), a wide flange beam, preferably hot rolled, a steel beam, a channel (C and MC) steel beam, a light gauge steel section, a light gauge metal joist, a timber beam, or any long, sturdy piece that can span a part of a building and support a raised floor. Beams could be either composite or non-composite members.

"Cementitious" means having the properties of cement.

"Column" is defined as a piece that provides vertical support and can be made of any material suitable for the size and purpose of a building, such as iron or steel column, a horizontal wide flange girder, iron or steel beam, or any compound structure.

"Conventional Reinforcement Means" includes welded wire fabric, reinforcing mesh, steel, splice, concrete reinforcing bars (rebar), prestressed concrete strand (PC strand), post-tensioned strand, or any material that adds tensile strength to the concrete slab.

A "duct" is a channel or tube used for conveying something. In concrete, it is usually a void that may be created using a light gauge hollow tube cast into the concrete. This void is typically grouted at a later date once conventional reinforcement means are installed in the duct.

The term "diaphragm" is used here in the structural engineering sense and is defined as a structural element that transmits lateral loads to the lateral load resisting elements of a structure.

"Grout" is a filling, which when poured into a receptacle will fill in the receptacle and consolidate the adjacent edges into a solid mass, such as cementitious mortar or other cement-based materials, bentonite, bentonite/sand mixtures, graphite-based materials, carbon nanotubes and nanofibers, or a similar material.

"Raised floor" refers to any floor in a building that is suspended and supported. It does not include a typical ground floor that is slab-on-grade.

"Reinforced Concrete Slab" is a concrete slab that is reinforced with Conventional Reinforcement Means.

"Torque" is defined as a twisting force that tends to cause rotation.

DETAILED DESCRIPTION OF THE DRAWINGS

Figure 1:
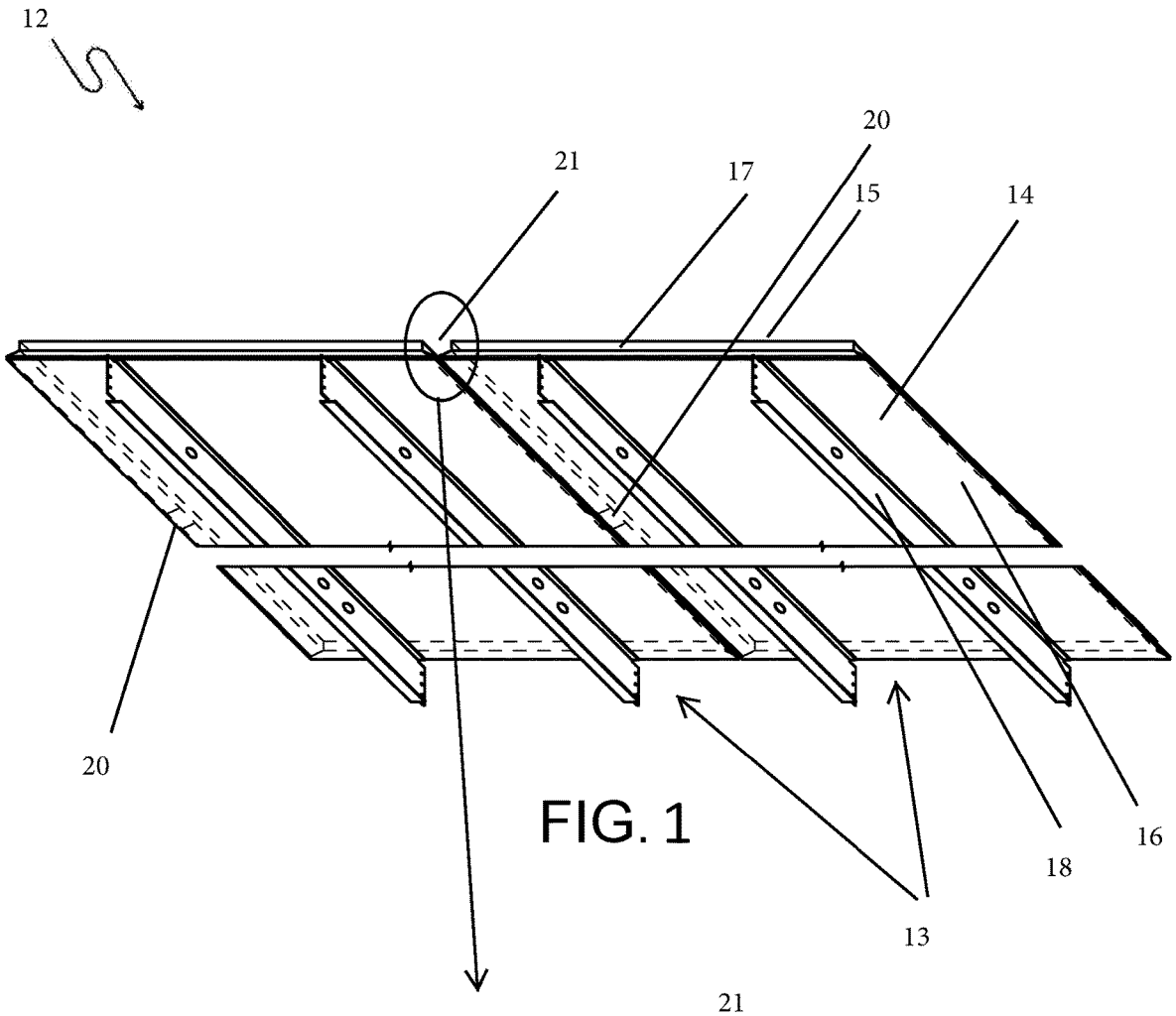
FIG. 1 is a bottom perspective view of the modular structural building system.

FIG. 1 shows the modular structural building system 12 comprising a plurality of precast raised floor panels 13, each precast raised floor panel 13 comprising a reinforced concrete slab 14 (concrete reinforcing means not shown, see FIGS. 4 and 5) having a top 15 and a bottom 16, each reinforced concrete slab 14 also having a plurality of edges 17, at least one edge 17 being generally angled such that the top 15 of the reinforced concrete slab 14 has less surface area than the bottom 16, at least one beam 18, and a means 19 of coupling the beam 18 to the bottom 16 of the reinforced concrete slab 14 (coupling means not shown, see FIGS. 4-6), a means 20 for connecting adjacent angled edges 17 of the precast raised floor panels 13 to each other, wherein once adjacent angled edges 17 are connected a receptacle 21 is created, said receptacle 21 being filled with grout 22.

Figure 2:
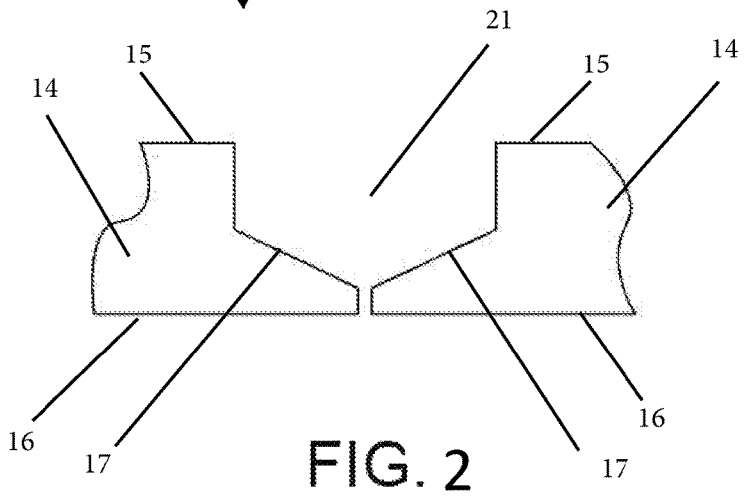
FIG. 2 is a magnification of the circled area of FIG. 1 showing a front view of the receptacle created when adjacent angled edges are connected.
Figure 7:
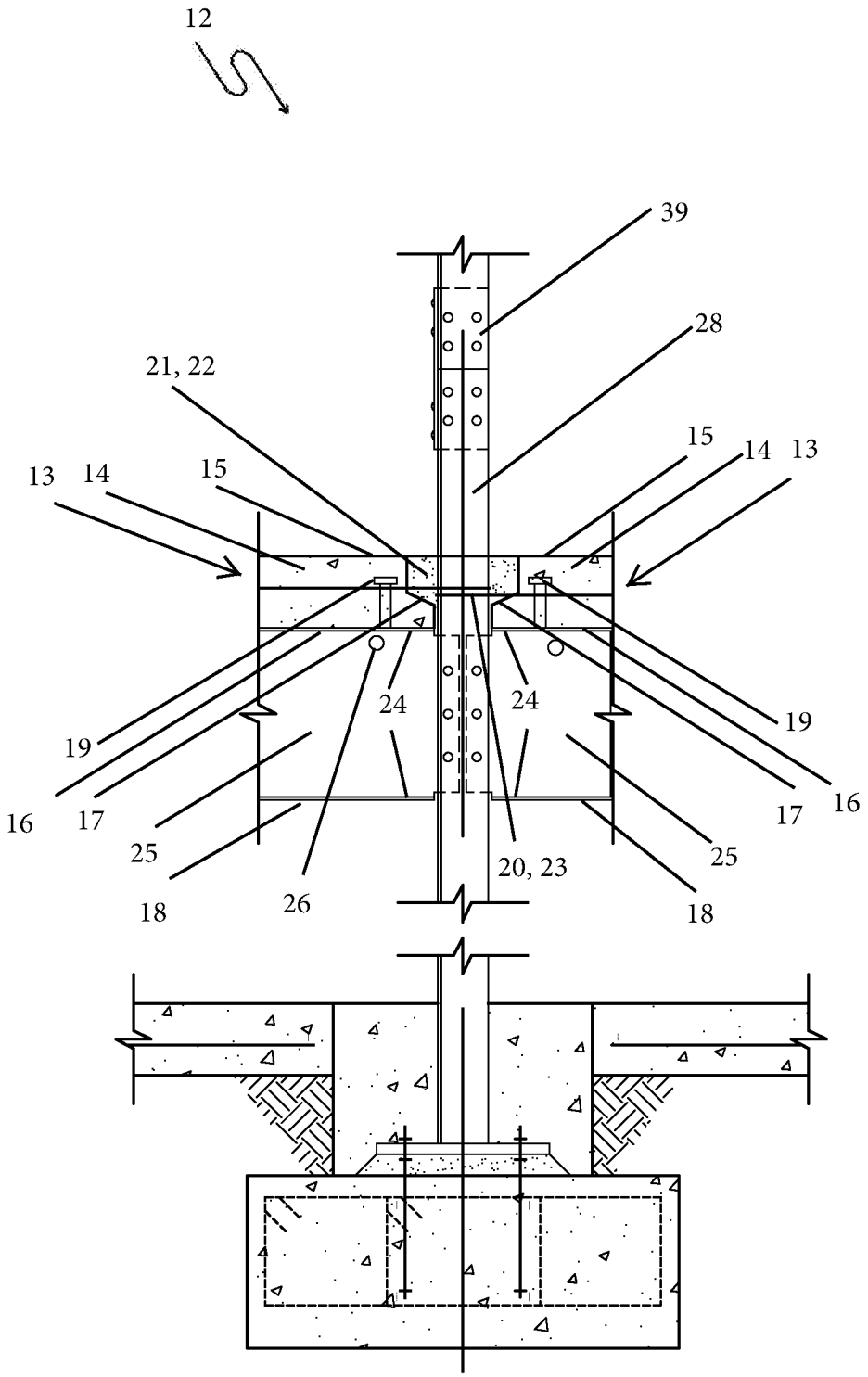
FIG. 7 is a side view of the modular structural building system and column assembly.
Figure 9:
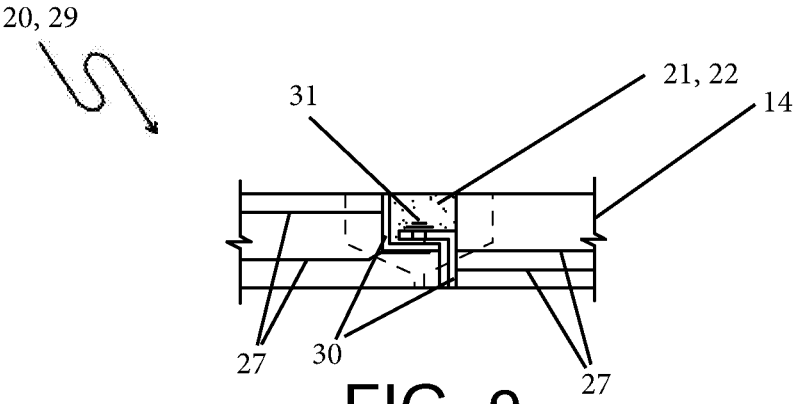
FIGS. 9 and 10 show two embodiments of a levelling connection assembly.
Figure 10:
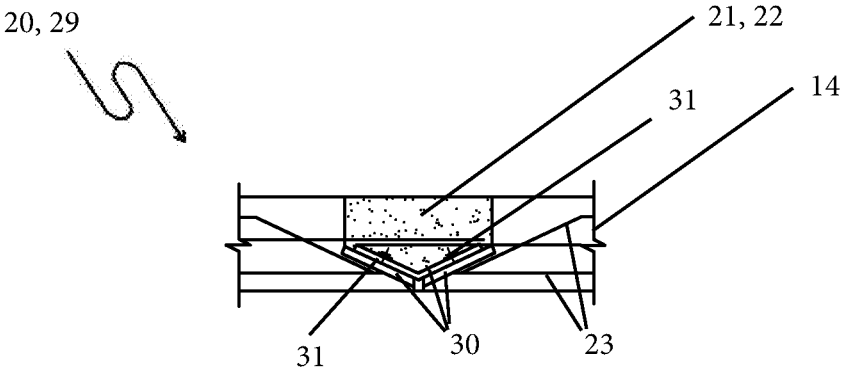

FIG. 2 is a magnification of the circled area of FIG. 1 and shows two representative edges 17, both edges 17 being generally angled such that the top 15 of the reinforced concrete slab 14 will have less surface area than the bottom 16, and a receptacle 21 being created by connecting the angled edges 17 together (connection means not show, see FIGS. 7, 9, and 10). A small gap, approximately one-half inch wide, may be present after the angled edges are connected for structural purposes. Tape or insulation may be used to seal the gap while grout is being poured into the receptacle.

Figure 3:
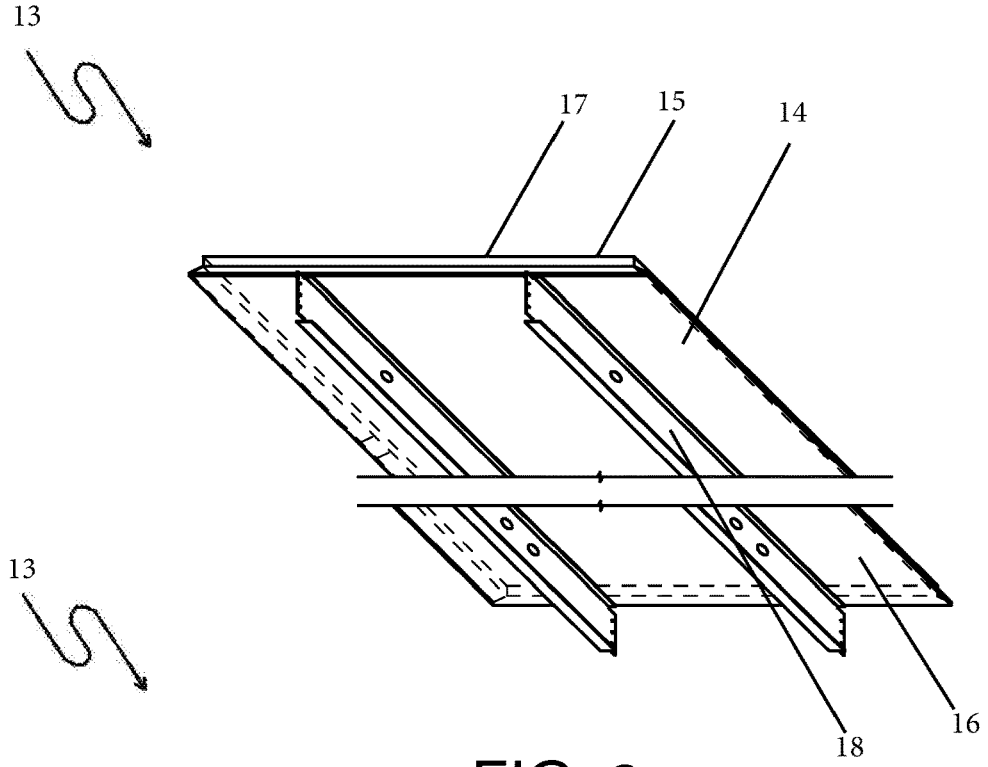
FIG. 3 is a bottom perspective view of a precast raised floor panel.
Figure 4:
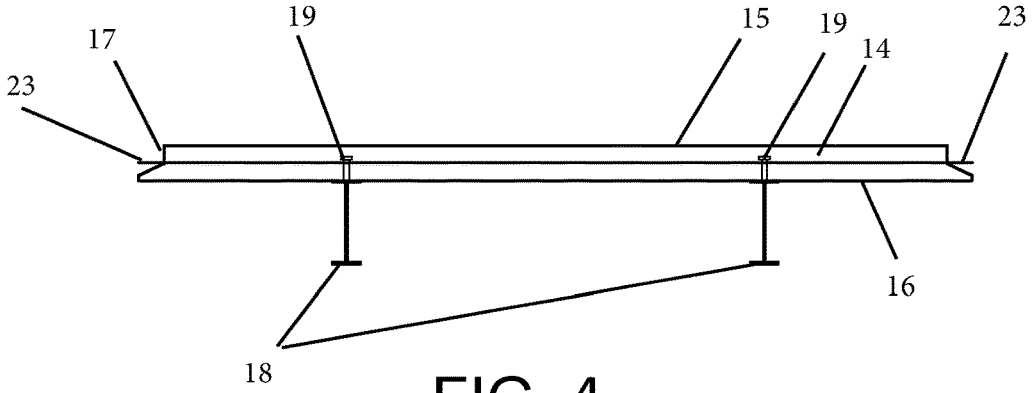
FIG. 4 is a front view of the precast raised floor panel of FIG. 3.
Figure 5:
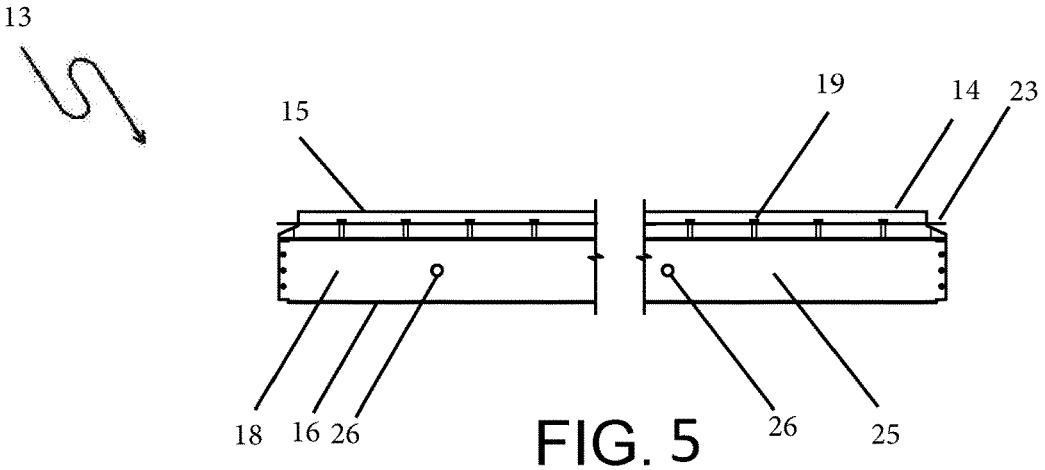
FIG. 5 is a side view of the precast raised floor panel of FIG. 3.
Figure 6:
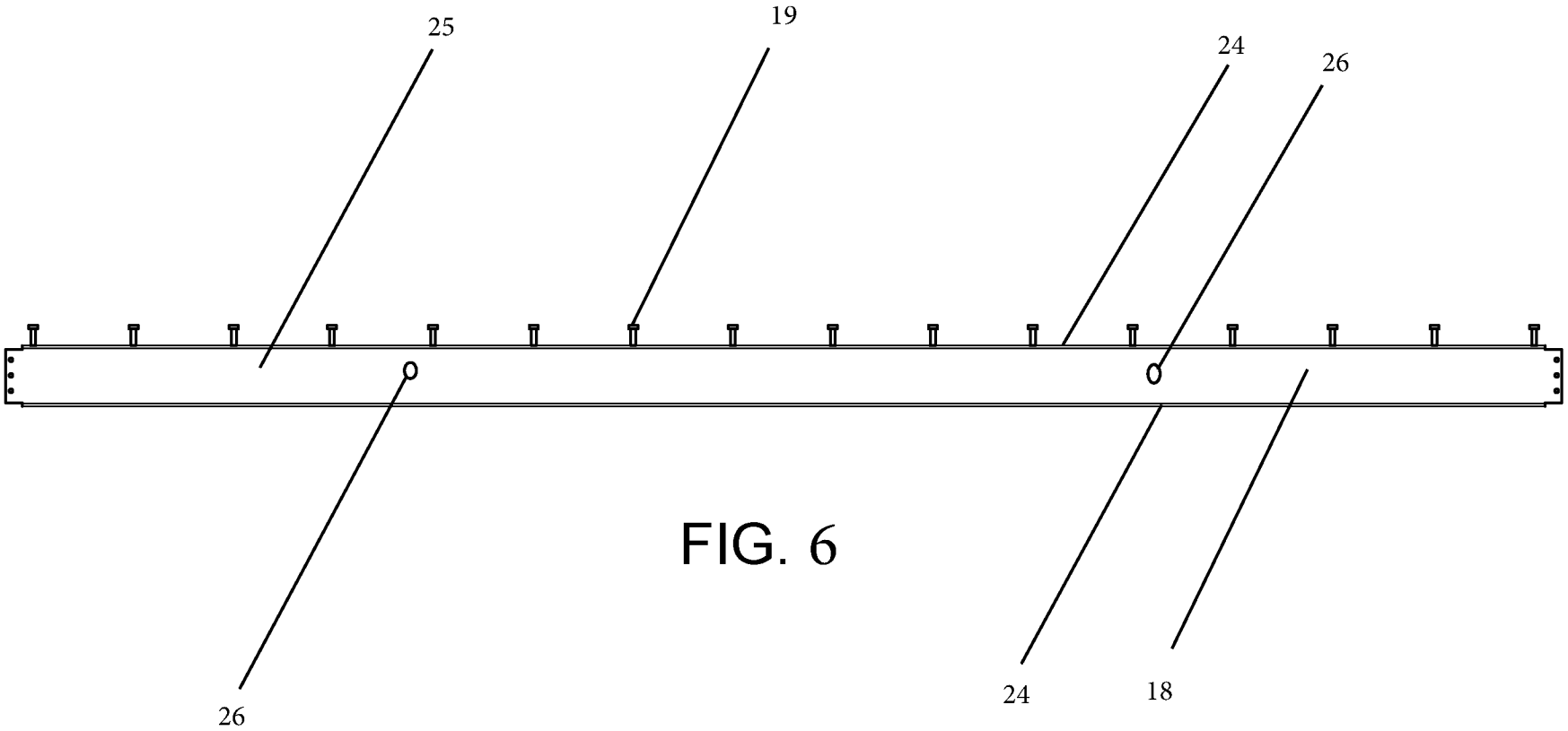
FIG. 6 is a side view of the beam.

FIG. 3 shows a precast raised floor panel 13, said precast raised floor panel 13 comprising a reinforced concrete slab 14 (concrete reinforcing means not shown, see FIGS. 4 and 5) having a top 15 and a bottom 16, said reinforced concrete slab 14 also having a plurality of edges 17, at least one edge 17 being generally angled such that the top 15 of the concrete slab has less surface area than the bottom 16, at least one beam 18, and a means 19 of coupling the beam 18 to the bottom 16 of the reinforced concrete slab 14 (coupling means not shown, see FIGS. 4-6).

FIG. 4 is a front view of the precast raised floor panel 13 of FIG. 3, said precast raised floor panel 13 comprising a reinforced concrete slab 14 having a top 15 and a bottom 16, and conventional reinforcing means 23, said reinforced concrete slab 14 also having a plurality of edges 17, at least one edge 17 being generally angled such that the top 15 of the concrete slab has less surface area than the bottom 16, at least one beam 18, and a means 19 of coupling the beam 18 to the bottom 16 of the reinforced concrete slab 14.

FIG. 5 is a side view of the precast raised floor panel 13 of FIG. 3, said precast raised floor panel 13 comprising a reinforced concrete slab 14 having conventional reinforcement means 23, at least one beam 18, and a means 19 of coupling the beam 18 to the bottom 16 of the reinforced concrete slab 14. In this embodiment, the beam includes a web 25, said web 25 containing at least one opening 26 to accommodate the routing of building construction materials. Also in this embodiment, the means 19 of coupling the beam 18 to the bottom 16 of the reinforced concrete slab 14 is headed anchor studs that are welded to the top flange of a hot rolled steel beam 18 and extend into the concrete slab 14. Size and quantity vary depending on project requirements.

In an alternative embodiment, the means 19 of coupling the beam 18 to the bottom 16 of the reinforced concrete slab 14 is a plurality of light gauge composite clips that attach to the top of the beam 18 and extend into the concrete slab 14 so that composite action is formed between the beam 18 and concrete slab 14.

FIG. 6 shows one beam 18, said beam comprised of two flanges 24, said flanges 24 being parallel to each other and connected to each other perpendicularly by a web 25 running the length of the flanges 24, said web 25 containing at least one opening 26 to accommodate the routing of building construction materials and a means 19 of coupling the beam 18 to the reinforced concrete slab 14 (slab not shown, see FIGS. 3-5).

FIG. 7 shows the modular structural building system 12 comprising a plurality of precast raised floor panels 13, each panel comprising a reinforced concrete slab 14 having a top 15 and a bottom 16, said reinforced concrete slab 14 having a plurality of edges 17, at least one edge 17 being generally angled such that the top 15 of the reinforced concrete slab 14 has less surface area than the bottom 16, at least one beam 18 comprised of two flanges 24, said flanges 24 being parallel to each other and connected to each other perpendicularly by a web 25 running approximately the length of the flanges 24. Also shown is a means 19 of coupling the beam 18 to the bottom of the reinforced concrete slab 14, a means 20 for connecting adjacent angled edges 17 of the precast raised floor panels 13 to each other, wherein once adjacent angled edges 17 are connected, a receptacle 21 is created, said receptacle 21 being filled with grout 22. In the embodiment shown here, the means 23 for reinforcing the reinforced concrete slab 14 is welded wire fabric that extends beyond at the angled edge 17 of the reinforced concrete slab 14 such that the means 20 for connecting the adjacent angled edges 17 together is the overlapping and connecting of each reinforced concrete slab's 14 welded wire fabric. The beam 18 is attached to a column 28 and the web 25 of at least one beam extends beyond the edge of the reinforced concrete slab 14 such that the extended web 25 can be received by and attached to the column 28. The column 28 in this embodiment is a double angle steel column 28 so that the web 25 of the beam 18 extends and projects between the two components of the double angle column 28. This removes the need of a shear tab and places the bolts in double shear. Column 28 size, bolt size, spacing, and quantities vary depending on project requirements. Also, in this embodiment, the means 19 of coupling the beam to the bottom 16 of the reinforced concrete slab 14 is a plurality of headed anchor studs. The system of this embodiment uses bolted connections between the web 25 of the beam 18 and column 28 sections. Bolt size, spacing, and quantities vary depending on project requirements. All bolts, nuts, and washers have standard specifications as per American Institute of Steel Construction (AISC). In some embodiments, the available length of columns 28 may be limited or there may be transportation and erection constraints. In that case, a plurality of columns 28 may be connected to each other in the same plane, or along their length, using a column splice 39. Many column options allow for pre-installation of columns 28 in the modular structural building system so that the system can be installed in a "folding table" at the building site.

A structural footer and ground floor concrete slab are shown in FIG. 7 for context but are not part of the claimed invention.

Figure 8:
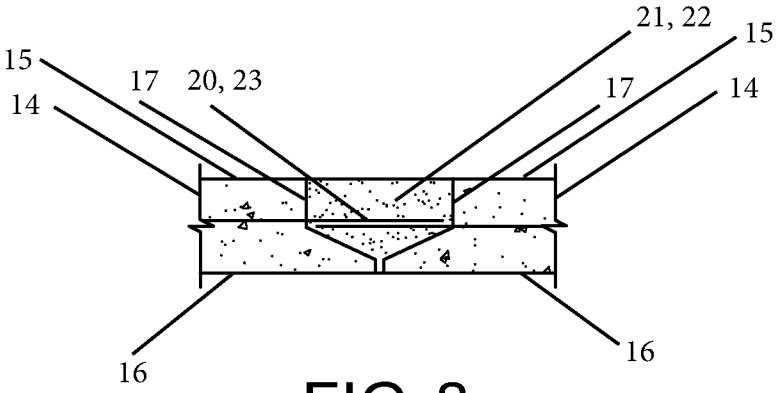
FIG. 8 is a cross-section of two adjacent, connected concrete slabs.

FIG. 8 is a cross-section of two adjacent, connected reinforced concrete slabs 14 each reinforced concrete slab 14 also having a plurality of edges 17, at least one edge 17 being generally angled such that the top 15 of the concrete slab has less surface area than the bottom 16, a means 20 for connecting adjacent angled edges 17 of the precast raised floor panels 13 to each other, wherein once adjacent angled edges 17 are connected a receptacle 21 is created, said receptacle 21 being filled with grout 22. In this embodiment, the means 23 for reinforcing the reinforced concrete slab 14 is rebar which extends beyond at least one edge 17 of the concrete slab 14 such that the means 20 for connecting the adjacent angled edges 17 together is the overlapping and connecting of each reinforced concrete slab's 14 rebar.

FIGS. 9 and 10 show two embodiments of a levelling connection assembly 29 comprised of a plurality of steel plates 30 connected by at least one mechanical fastening assembly 31 wherein torque is applied to the mechanical fastening assembly 31 to draw, or push/pull, two adjacent precast raised floor panels 13 level in the vertical direction providing for a level raised floor. The levelling connection assemblies 29 are located in the receptacles 21 and spaced apart at pre-determined locations based on project size and project levelness and flatness requirements. The levelling connection assemblies 29 are ultimately concealed by the grout 22. In the preferred embodiment, the levelling connection assembly 29 is located on the long sides of the floor panels.

For example, FIG. 9 shows one embodiment of a levelling connection assembly 29 comprised of overlapping steel angle plates 30 embedded into adjacent reinforced concrete slabs 14 and attached to a weldable conventional reinforcing means 23 such as rebar. In this embodiment, the mechanical fastening assembly 31 is comprised of a weldable rebar 27 that is welded to the bottom and side of a steel angle 30, and a threaded bolt 31 or threaded rod that is then welded to the bottom angle and inserted through a hole in the other panel's angle where the steel angles 30 overlap. The threaded bolt 31 projects up into the receptacle 21 between adjacent angled edges 17 of reinforced concrete panels 13. Washers and nuts are then installed on the threaded rod or bolt. The tightening of the nut on the bolt or rod draws the two adjacent precast raised floor panels 13 level in the vertical direction providing for a level raised floor. This levelling connection assembly 29 also serves as the means 20 for connecting adjacent angled edges 17 of the precast raised floor panels 13 to each other.

FIG. 10 shows another embodiment of a levelling connection assembly 29 comprised of opposing steel plates 30 embedded into adjacent reinforced concrete slabs 14 and attached to a weldable conventional reinforcing means 23 such as rebar. In this embodiment, the mechanical fastening assembly 31 is comprised of weldable rebar 27 that is welded to the bottom of each steel plate 30 and threaded bolts or rods 31 that are then welded to the top surface of each steel plate 30. These threaded bolts project up into the receptacle 21 between adjacent angled edges 17 of reinforced concrete panels 13. A third plate 30 with two holes is placed upon the first two steel plates 30 and over the two threaded bolts or rods. Washers and nuts are then installed on the two threaded rods or bolts 31. The tightening of the nuts on the bolts or rods draws the two adjacent precast raised floor panels 13 level in the vertical direction providing for a level raised floor. This levelling connection assembly 29 also serves as the means 20 for connecting adjacent angled edges 17 of the precast raised floor panels 13 to each other.

Figure 11:
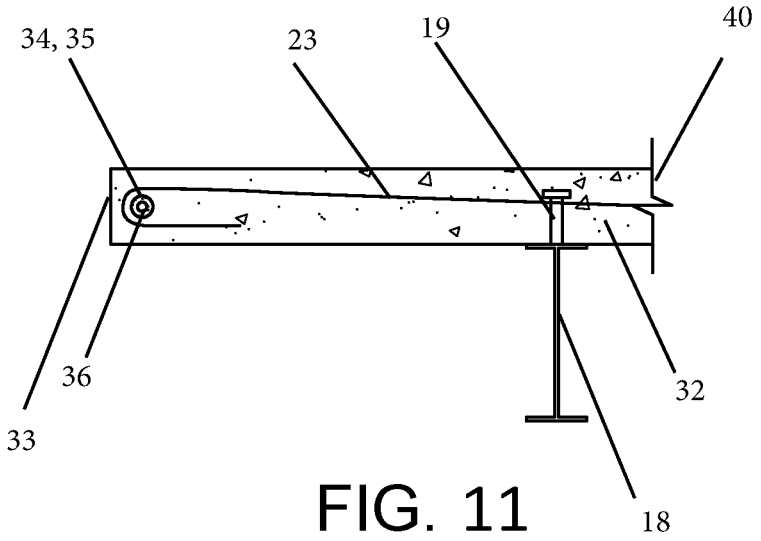
FIGS. 11 and 12 show two embodiments of perimeter slab reinforcement means to create a continuous raised floor diaphragm.
Figure 12:
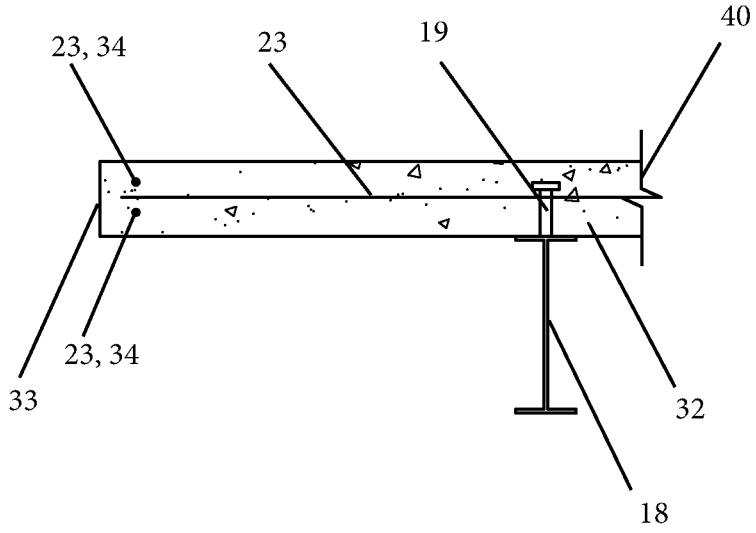

FIGS. 11 and 12 show two embodiments of modular structural building system 12 further comprising at least one perimeter precast raised floor panel 40 comprising a reinforced perimeter concrete slab 32 having a plurality of edges 33, at least one edge 33 being generally flat, said flat edge being connected to a building's perimeter walls. At least one duct 34 is located inside the reinforced perimeter concrete slab 32 that is generally parallel to and near the flat edge 33, said duct 34 being capable of receiving a conventional reinforcement means 23, said conventional reinforcing means 23 being installed in all perimeter precast raised floor panels 40 in a continuous manner such that, when overlapping the reinforcing means 23 of the concrete slab 14, a raised floor structural diaphragm is created.

FIG. 11 shows one embodiment where the duct 34 is a metal duct 35 embedded in the reinforced concrete slab 14 during the precasting process. A continuous cable 36 is field placed through the embedded metal duct 35.

FIG. 12 shows another embodiment where the conventional reinforcing means 23 being installed in all perimeter precast raised floor panels 40 in a continuous manner is rebar.

Figure 13:
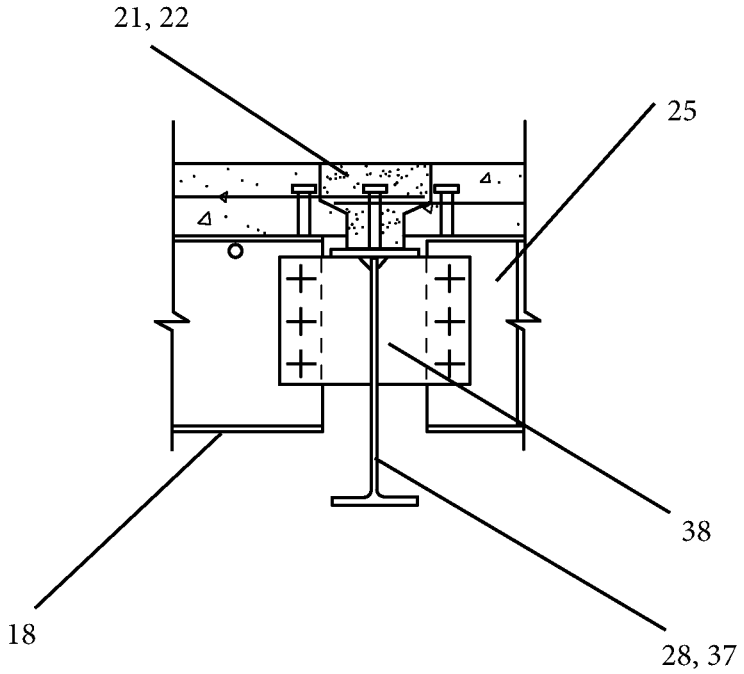
FIG. 13 is a side view of an embodiment wherein the column is a horizontal wide flange girder.

FIG. 13 shows an embodiment wherein the column 28 is a horizontal wide flange girder 37. A sheer tab or angle 38 is welded or bolted to the horizontal wide flange girder 37 and connected to the web 25 of the beam 18.

Figure 14:
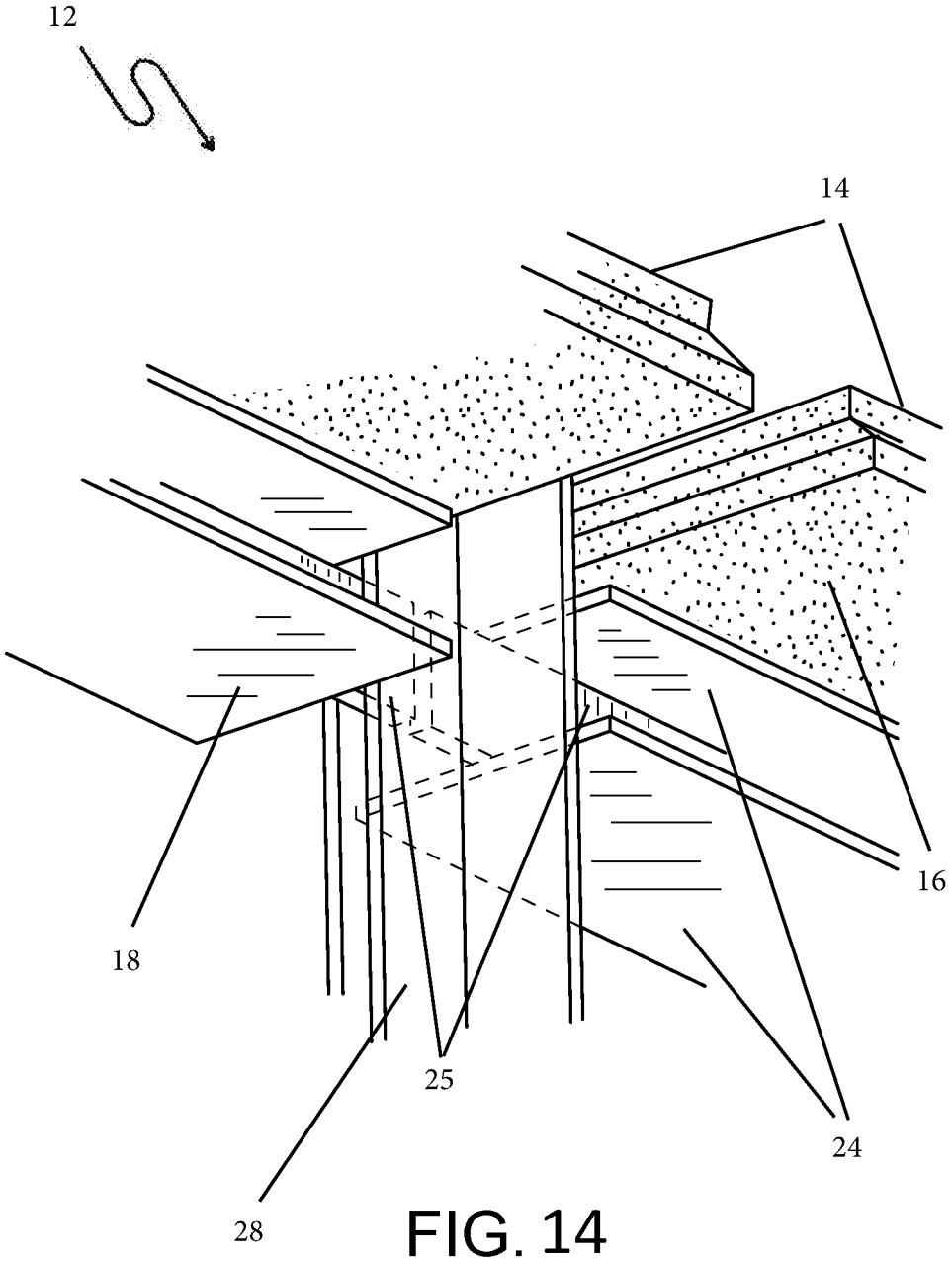
FIG. 14 is a bottom perspective view the modular structural building system connected to a column. Connection details and other details are omitted for simplicity.

FIG. 14 depicts the modular structural building system 12 comprising a plurality of precast raised floor panels 13, each precast raised floor panel 13 comprising a reinforced concrete slab 14 having a top 15 and a bottom 16, at least one beam 18, said beam comprised of two flanges 24, said flanges 24 being parallel to each other and connected to each other perpendicularly by a web 25 running the length of the flanges 24, and a means 19 of coupling the beam 18 to the reinforced concrete slab 14 (coupling not shown, see FIGS. 3-5), wherein the beam 18 is attached to a column 28. In this embodiment, the column 28 is a double angle column. For simplicity, connection details and other details are not shown in FIG. 14.

Figure 15:
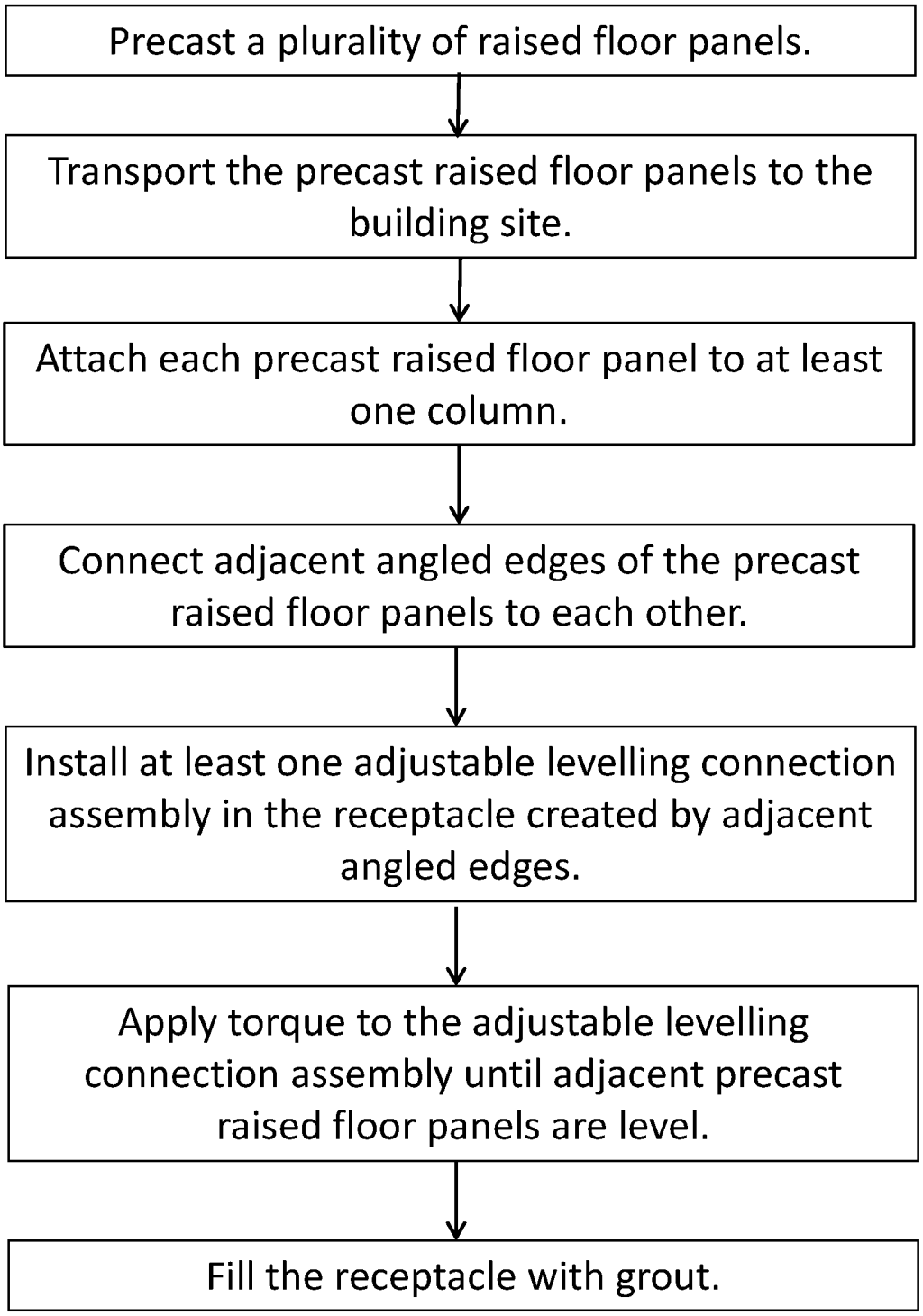
FIG. 15 is flow chart of the method of the present invention.

FIG. 15 is a flow chart depicting the method of the present invention using the modular structural building system described herein to install raised floors comprising the steps of precasting a plurality of raised floor panels, transporting the precast raised floor panels to the building site, attaching each precast raised floor panel to at least one column such that the precast raised floor panels are suspended and stable enough for construction personnel to walk on the precast raised floor panels, connecting adjacent angled edges of the precast raised floor panels to each other, installing within the receptacle created by connecting adjacent angled edges to each other at least one adjustable levelling connection assembly, said assembly being capable of using torque to draw two adjacent raised floor panels level, applying torque to the adjustable levelling connection assembly until the adjacent precast raised floor panels are level; and filling the receptacle with grout.

Whereas the figures and description have illustrated and described the concept and preferred embodiment of the present invention, it should be apparent to those skilled in the art that various changes may be made in the form of the invention without affecting the scope thereof. The detailed description above is not intended in any way to limit the broad features or principles of the invention, or the scope of patent monopoly to be granted.

I claim:

1. A method of using a modular structural building system to install raised floors comprising the steps of:

a. precasting a plurality of raised floor panels, said raised floor panels having a top and a bottom and a plurality of edges, one or more of said edges being generally angled such that the tops of the plurality of said raised floor panels have less surface area than the bottoms;

b. precasting said plurality of raised floor panels by precasting an amount of wet concrete to a plurality of beams selected from the group consisting of wide flange steel beams, timber beams, and light gauge steel sections;

c. transporting the precast raised floor panels to a final panel location;

d. attaching the plurality of precast raised floor panels to at least one column such that the plurality of precast raised floor panels are suspended and stable enough for construction personnel to walk on the plurality of precast raised floor panels, said plurality of precast floor panels having a perimeter, said perimeter containing hollow ducts configured to accommodate a conventional reinforcement means selected from the group consisting of cable, rebar, prestressed concrete strand, and post-tensioned concrete strand, said conventional reinforcement means configured to provide a continuous structural diaphragm for the plurality of precast raised floor panels, said ducts configured to receive grout after receiving said conventional reinforcement means;

e. creating a receptacle by said angled edges of adjacent raised floor panels of said plurality of raised floor panels; and f. filling the receptacle with grout;

g. installing within the receptacle created by said angled edges of adjacent raised floor panels of said plurality of raised floor panels at least one adjustable levelling connection assembly, said adjustable levelling connection assembly configured to be capable of using torque to draw two adjacent raised floor panels level; and h. applying torque to the adjustable levelling connection assembly until the adjacent precast raised floor panels are level.

* * * * *